US005476297A

United States Patent [19]

Lombard

[11] Patent Number: 5,476,297

[45] Date of Patent: Dec. 19, 1995

[54] RETRACTABLE BALL SHAGGER AND CARRYING DEVICE

[75] Inventor: Mitchell Lombard, Dallas, Tex.

[73] Assignee: Sport Supply Group, Inc., Farmers Branch, Tex.

[21] Appl. No.: 226,252

[22] Filed: Apr. 11, 1994

[51] Int. Cl.[6] ..... A63B 47/02

[52] U.S. Cl. ..... 294/19.2

[58] Field of Search ..... 294/19.1, 19.2; 56/328.1, 332; 221/65; 273/32 B, 32 F, 162 E, 162 F; 224/919; 285/298, 301, 302, 401, 402; 403/104, 109, 348, 349, 377

[56] References Cited

U.S. PATENT DOCUMENTS

| | | | |
|---|---|---|---|
| 1,365,851 | 1/1921 | Reynolds | 403/109 X |
| 2,203,170 | 6/1940 | Macdonald | 294/19.2 |
| 2,832,188 | 4/1958 | Harrell et al. | 294/19.2 X |
| 3,186,593 | 6/1965 | Miotke | 294/19.2 X |
| 3,558,170 | 1/1971 | Stanworth | 294/19.2 |
| 4,046,413 | 9/1977 | Jeninga | 294/19.2 |
| 4,063,769 | 12/1977 | Zimmer | 294/19.2 |
| 4,522,438 | 6/1985 | Logue | 294/19.2 |
| 4,917,282 | 4/1990 | Hufford | 224/919 X |
| 4,974,894 | 12/1990 | Dubow | 294/19.2 |
| 5,026,061 | 6/1991 | Davis | 294/19.2 X |
| 5,060,996 | 10/1991 | Garnes | 294/19.2 |

FOREIGN PATENT DOCUMENTS

| | | | |
|---|---|---|---|
| 682899 | 11/1952 | United Kingdom | 294/19.2 |

*Primary Examiner*—Johnny D. Cherry
*Attorney, Agent, or Firm*—David H. Judson

[57] ABSTRACT

A ball shagger and carrying device for balls retrieved is provided. The shagger portion of the device is constructed generally of a body, a retaining member, an extensible member and a shagging mechanism arranged such that the members form a retractable tubular member for convenient storage and transportation. The carrying portion of the device is a bag or the like attached to the end opposite of the shagging portion. In a preferred embodiment, the shagger member eliminates contaminant build-up upon retraction of the extensible member. In an alternative embodiment, the tube or shagger portion of the device is adjustable such that the inside diameter of the tube can be increased or decreased to shag or retrieve balls of varying sizes.

21 Claims, 4 Drawing Sheets

RETRACTABLE BALL SHAGGER AND CARRYING DEVICE

TECHNICAL FIELD

The present invention relates generally to ball retrieving devices and more specifically to retractable ball shaggers and carrying devices for shagged balls. The present invention is particularly well-suited for use in shagging and carrying golf balls.

BACKGROUND OF THE INVENTION

Golf ball carrying and retrieving devices are well-known in the prior art. For example, U.S. Pat. No. 4,917,282 to Hufford illustrates a holder for golf balls and the like. In accordance with the teachings of this patent, retention of the ball or balls in the holder is achieved by frictional and radial compression forces exerted upon the balls.

It is also known in the prior art to combine golf ball retrieving holders with other golf apparatus or equipment. For example, U.S. Pat. No. 5,026,061 to Davis discloses a golf practice flag assembly and ball retriever holder therefor. A portion of this device includes a handled, hollow tube ball retriever having laterally extending, upper and lower bracket members that form a holder for the separated flagstaff segments.

It is further known in the prior art to provide a golf ball shag and carrying device having a tube for shagging the golf balls. U.S. Pat. No. 5,060,996 to Garnes illustrates this type of golf ball carrier and shagger. The tube has several longitudinal holes that are large enough for an individual to place his fingers therethrough. In use, O-rings placed over the ends of the tube and fit in a slot flex outward allowing the golf balls to enter the tube. The O-rings then return to their original position to retain the golf balls in the tube.

U.S. Pat. No. 2,203,170 to MacDonald also relates to a ball retriever having a tube and a carrying sack arrangement. While this device has proven useful, one of the disadvantages of the ball retriever in accordance with U.S. Pat. No. 2,203,170 is that the tube is bulky and cannot be readily stored or transported when the device is not in use. U.S. Pat. No. 4,974,894 relates to a golf ball retrieving device. The device disclosed in U.S. Pat. No. 4,974,894 can be used to withdraw a golf ball from water by providing an extensible reach and an expandable cage, thereby allowing the user to retrieve and entrap a golf ball.

It would therefore be desirable to provide a golf ball shagger and carrying device which overcomes the shortcomings associated with the prior art.

BRIEF SUMMARY OF THE INVENTION

It is thus an object of the present invention to provide a ball shagger and carrying device having a retractable tubular member for easy storage, transportation and use.

It is yet another object of the present invention to provide a ball shagger which is cost effective and simple to manufacture and use, yet still retains the aforementioned advantages.

It is a further object of the present invention to provide a ball shagger which can be utilized for a variety of sports, including golf, tennis and baseball.

These and other objects of the invention are provided in a ball shagger and carrying device formed of several members including a shagging mechanism. The members are arranged in a manner such that the shagging mechanism can be retracted or collapsed so that the overall device is conveniently stored, transported and used. In a preferred embodiment, one end of the shagger has a bag or the like attached thereto for storing retrieved balls. Additionally, the shagger portion of the device preferably includes a contaminant release design that eliminates build-up of dirt or other particles in the shagger.

In accordance with yet a further feature of the invention, the shagger mechanism of the device is adjustable radially such that the inside diameter of the shagger mechanism can be increased or decreased to shag or retrieve balls of varying sizes. The shagger and carrying device of the present invention is thus suitable for use in connection with a variety of sports such as golf, tennis, or baseball. This embodiment is particularly desirable since radial adjustment of the tube only requires rotating a portion of the shagger in one direction to increase the diameter and rotating the same portion in the opposite direction to decrease the diameter.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

Similar reference characters refer to similar parts throughout the several views of the drawings.

DETAILED DESCRIPTION

The present invention provides a ball shagger and a carrying device which is readily compacted for easy transportation, storage and use. Primarily, this is accomplished by providing a shagger having a retractable tube for shagging or retrieving balls.

Figures 1, 1A:
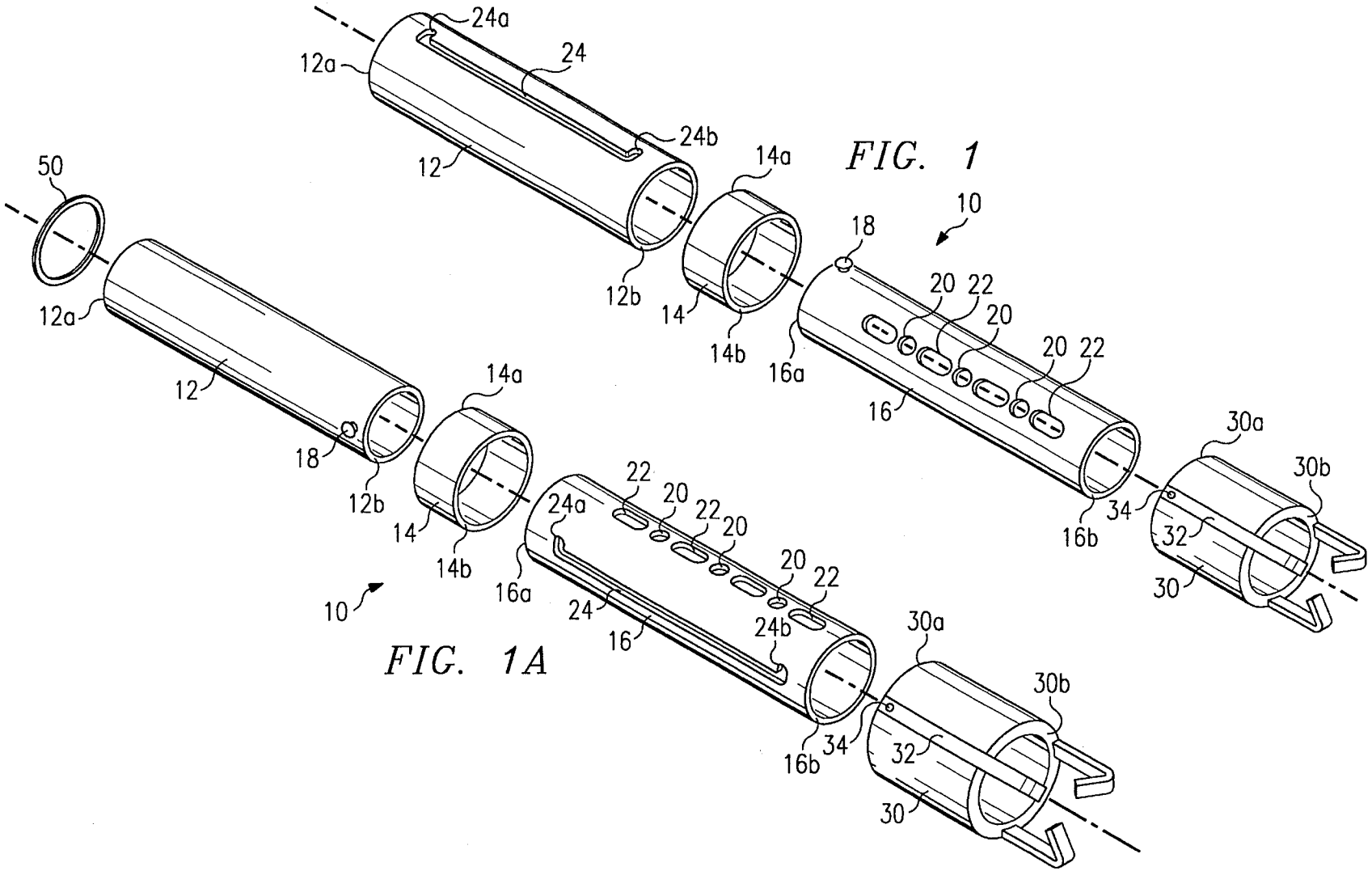
FIG. 1 is an exploded, elevation view showing the four members of the shagger in accordance with the present invention.
FIG. 1A is an exploded, elevation view showing the four members of the shagger in accordance with an alternative embodiment of the present invention.

Reference is now had to FIG. 1 in which an unassembled shagger 10 is illustrated. Shagger 10 is formed primarily from tubular body 12, retaining member 14, extensible member 16 and shagging mechanism 30. Each member 12, 14, 16 and 30 has a tubular configuration, first ends 12*a*, 14*a*, 16*a* and 30*a* and second ends 12*b*, 14*b*, 16*b*, and 30*b*, respectively. While not meant to be limiting, each of the components of shagger 10 are preferably formed of anodized aluminum. However, the shagger may be constructed of another suitable material which is sufficiently rigid to shag balls and has a member capable of being retracted.

The shagger of the present invention may be formed without retaining member 14. Body 12 is then slidably positioned within extensible member 16 when the inner diameter of body 12 is less than that of extensible member 16. Alternatively, extensible member 16 is slidably positioned within body 12 when the inner diameter of extensible member 16 is less than that of body 12.

Preferably, however, retaining member 14 cooperates with apertures 20 and 22 in extensible member 16 to eliminate contaminant build-up such as dirt or the like. In this embodiment, body 12 has a slightly less diameter than that of retaining member 14 such that second end 12*b* is adapted to be received inside first end 14*a*. Second end 12*b* of body 12 is held inside first end 14*a* by an adhesive or the like. Alternatively, body 12 may be secured to retaining member 14 by welding the members permanently to one another. Similarly, extensible member 16 has a slightly smaller diameter than retaining member 14 such that first end 16*a* of extensible member 16 fits inside of second end 14*b* of retaining member 14. Preferably, extensible member 16 has a slightly smaller diameter than body 12. As discussed herein, extensible member 16 is thus capable of being retracted into body 12. In an alternative embodiment of the invention, however, extensible member 16 has a larger diameter than body 12 so that extensible member 16 is retracted over body 12.

Body 12 includes a slot 24 extending along the longitudinal axis. As shown in FIG. 1, slot 24 has first and second end portions, 24*a* and 24*b*, respectively. Slot 24 serves as a locking or securing mechanism for the extensible member 16. While not meant to be limiting, fastener 18 is preferably positioned on extensible member 16 in such a manner that when shagger 10 is fully extended, fastener 18 locks into end portion 24*b* and when shagger 10 is retracted, fastener 18 is secured in end portion 24*a*. In this manner, the shagger is held secure whether the device is positioned for use or whether it is collapsed for travel or storage. Preferably, fastener 18 is a screw, bolt or the like. However, any type of fastener which is capable of securing the extensible member 16 from movement may be utilized. Alternative configurations for end portions 24*a* and 24*b* are also suitable in accordance with the present invention. For example, slot 24 and end portions 24*a* and 24*b* may be generally I-shaped such that fastener 18 is still capable of being secured such that extensible member 16 is held stationary.

In yet another embodiment of the present invention as illustrated in FIG. 1A, the diameter of extensible member 16' is greater than that of body 12'. Slot 24' and end portions 24*a'* and 24*b'* are positioned on extensible member 16' while fastener 18' is positioned on body 12' near second end 12*b'*. End portion 24*a'* is positioned near first end 16*a'* of extensible member 16' while end portion 24*b'* is positioned near second end 16*b'* such that when shagger 10 is fully extended, fastener 18' locks into end portion 24*a'* a and when shagger 10 is retracted, fastener 18' is secured in end portion 24*b'* on extensible member 16'.

Extensible member 16 preferably includes apertures 20 and 22 positioned along the longitudinal axis as shown in FIGS. 1–1A. Apertures 20 and 22 facilitate release of dirt and other liquids or solids such that contaminate build-up is eliminated in the shagger 10. Apertures 20 and 22 are preferably of varying sizes to facilitate such release. Dirt is automatically eliminated from the tube when the shagger is retracted or collapsed. This is accomplished by entrapped golf balls forcing dirt particles and the like to apertures 20 and 22. When extensible member 16 is retracted, dirt and other such particles are pushed off the extensible member upon contact with retaining member 16. This provides a distinct advantage over prior art shaggers which are not retractable and thus do not force dirt out of the tube when retracted.

Figure 2:
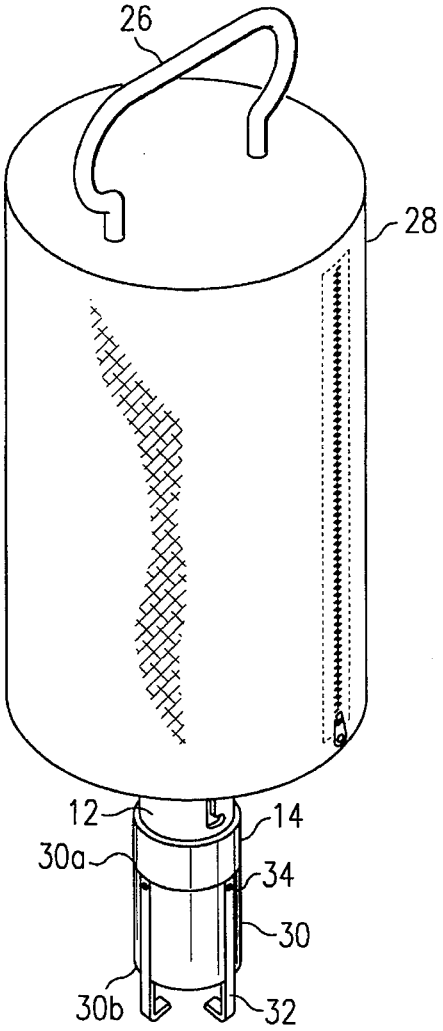
FIG. 2 is an elevation view of the shagger and carrying device in which the extensible member is retracted in accordance with the present invention.

Referring now to FIG. 2, the shagger and carrying device in accordance with the present invention are shown. Carrying device 28 is a bag or the like. In a preferred embodiment, carrying device 28 is formed of a durable nylon and is capable of housing up to 75 golf balls. A handle 26 is provided such that balls may be shagged without requiring the user to bend over. Preferably, handle 26 is an inverted generally U-shaped configuration or the like and is formed of a rigid material. This allows the user to grasp the device easily and to apply pressure to the shagger in a more uniform distribution. In this manner, the shagger is maintained steady while in use.

Alternatively, shagger 10 may be used as the carrying device and the user simply applies pressure to first end 12*a* of body 12 to shag balls. In this embodiment, an end cap 50 as illustrated in FIG. 1A or the like may be placed over end 12*a* to retain the balls therein.

As further shown in FIG. 2, body 12 extends from an opening in carrying device 28. Shagging mechanism 30 of shagger 10 has first and second ends, 30*a* and 30*b*, respectively. As set forth more fully herein, shagging mechanism 30 includes a plurality of recesses 40 (not shown in FIG. 2) extending longitudinally. A corresponding number of shagging members 32 are positioned over recesses 40 and attached to shagging mechanism 30 by fasteners 34. In one embodiment of the invention, there are three recesses 40 and three corresponding shagging members 32 positioned equidistant around shagging mechanism 30. Fastener 34 may be a screw, bolt or the like.

Figure 3:
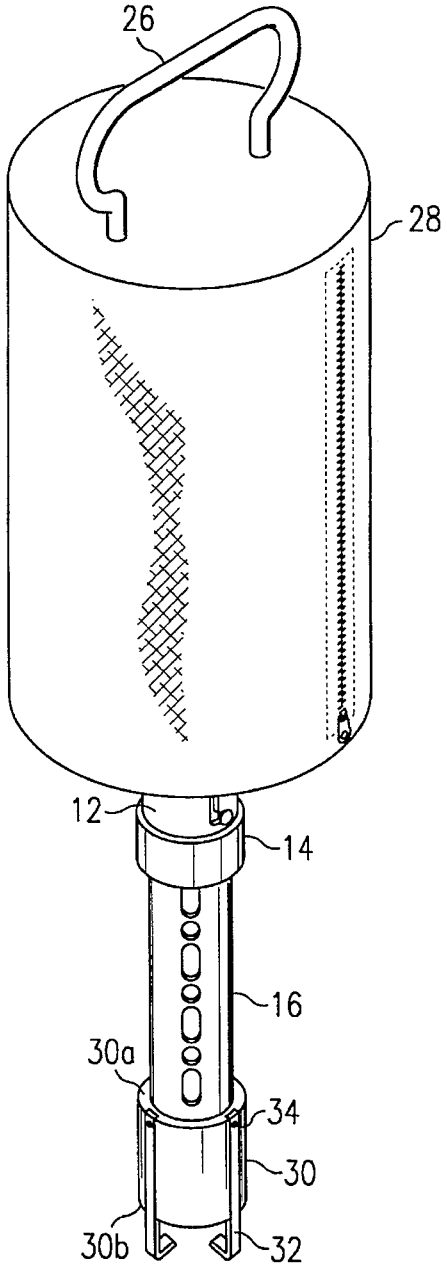
FIG. 3 is an elevation view of the shagger and carrying device in which the extensible member is partially extended according to the teachings of this invention.

When shagger 10 is retracted as shown in FIG. 2, shagging mechanism 30 is adjacent to retaining member 14 such that extensible member 16 is not visible. FIG. 3 illustrates the shagger and carrying device of the present invention in which shagger 10 is partially extended. As can be seen from the drawings, extensible member 16 becomes visible as the shagger is extended for use.

Figure 4:
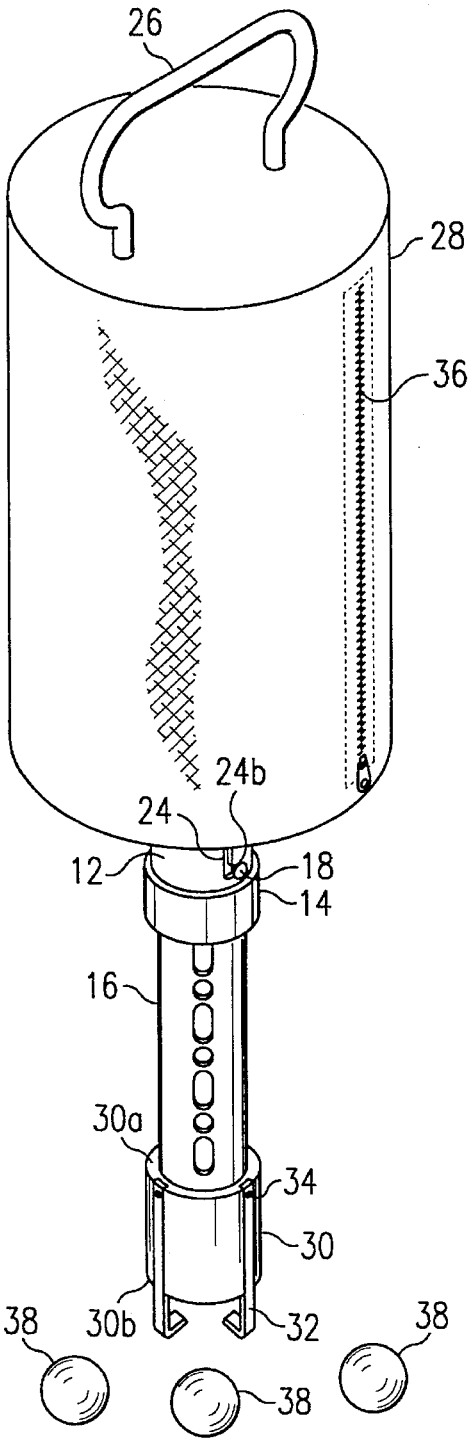
FIG. 4 is an elevation view of the shagger and carrying device in which the extensible member is fully extended and is ready for use in accordance with the present invention.

Referring now to FIG. 4, the shagger 10 is shown fully extended and the shagger is ready for use. The shagger 10 is held stationary by fastener 18 being secured in second end portion 24*b* of slot 24. Carrying device 28 includes a resealable opening 36 as shown in FIG. 4. Slot 36 is preferably a zipper or the like. This construction allows shagged balls 38 to be retrieved by unzipping slot 36.

Figure 5A:
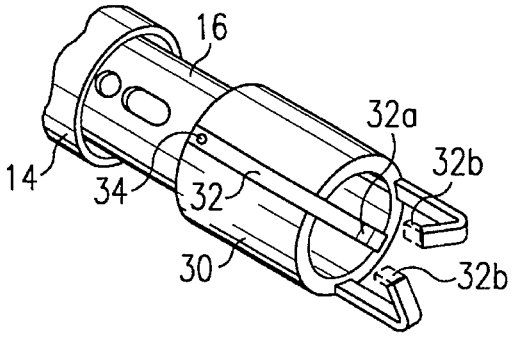
FIGS. 5A–5B are side elevation views of the bottom portion of the shagging mechanism incorporating the principles of the present invention.
Figure 5B:
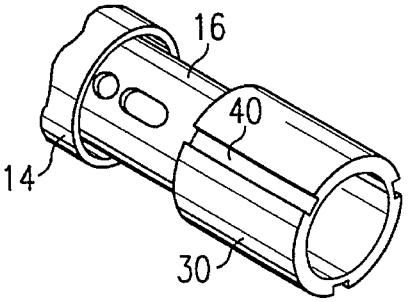
Figure 6:
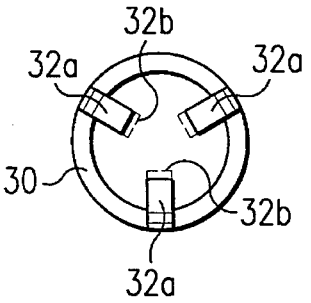
FIG. 6 is a bottom view of the shagging mechanism according to the present invention.

FIG. 5A illustrates the shagging member 32 positioned on shagging mechanism 30 while FIG. 5B shows shagging mechanism 30 with shagging member 32 removed such that recess 40 can be seen. Preferably, shagging members 32 are generally L-shaped with the longitudinal portion being positioned over recesses 40. The lip portion 32*a* of each shagging member 32 partially extends over the second end 30*b* of shagging mechanism 30 as illustrated in FIG. 6. Lip portions 32*a* preferably extend at an inwardly upward angle. In a more preferred embodiment, lip portions 32*a* include extensions 32*b*, shown in phantom in FIGS. 5A and 6. Extensions 32*b* extend upward toward handle 26. This allows balls to be shagged.

Figure 7:
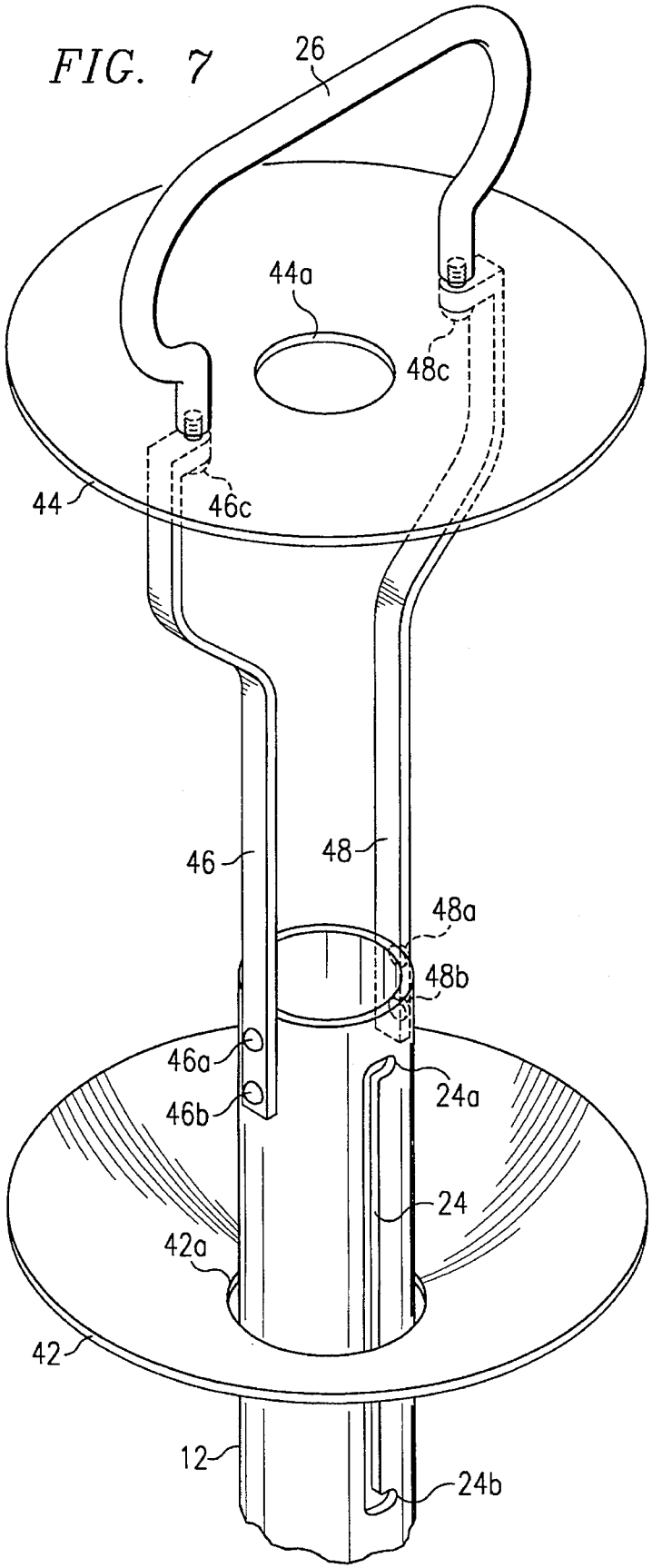
FIG. 7 is a side view of the carrying device in which the bag has been removed in accordance with the present invention.

The carrying device of the present invention is shown in FIG. 7 with the bag portion 28 removed. Preferably, the carrying device includes upper and lower plates, 42 and 44, respectively. In a preferred embodiment, plates 42 and 44 are formed from plastic and curve slightly inward. Each plate 42, 44 has an opening 42*a* and 44*a* respectively such that a portion of shagger 10 may be extended therethrough. In the embodiment shown in FIG. 7, body 12 is extended through opening 42*a* but not through opening 44*a*. Body 12 is preferably not attached to plate 42 so that the bag may be moved along the longitudinal axis, if desired.

Handle 26 is secured to plate 44 by legs 46 and 48. Legs 46 and 48 are attached to body 12 of shagger 10 by fasteners 46*a* and 48*a*. Preferably, fasteners 46*b* and 48*b* are also included to provide additional stability. Legs 46 and 48 are attached to plate 44 and handle 26 by fasteners 46*c* and 48*c*, respectively.

The ball shagger and carrying device in accordance with the present invention functions as follows. In order to prepare the shagger for use, fastener 18 is rotated radially in a direction opposite first end portion 24*a* of slot 24. Fastener 18 is then moved longitudinally along slot 24 such that extensible member 16 is extended outward. Upon reaching the bottom of slot 24, fastener 18 is rotated radially towards second end portion 24*b* of slot 24, thereby securing shagger 10 in place for use.

The user then grasps handle 26 and places the shagger 10 over a ball 38 to be shagged as illustrated in FIG. 4. Pressure is exerted by the user in a downward direction such that lip portions 32*a* and extensions 32*b* of shagging members 32 flex outward and allow ball 38 to enter shagger 10. This is achieved by fasteners 34 being attached to shagging mechanism 30 at a distance sufficient to allow shagging members 32 to be forced away from recesses 40 when pressure is imparted on ball 38 and transferred to shagging members 32. Shagging members 32 then return to their original position after ball 38 has entered the shagger, thereby trapping the ball in the shagger. This process is repeated until all of the balls 38 enter shagger 10. As each additional ball is added to shagger 10, the previous ball is forced upward towards handle 26. When shagger 10 has reached its capacity, the first ball shagged overflows and exits first opening 12*a* of body 12 and falls into carrying device 28.

Shagged balls 38 may be reused by opening slot 36 and removing the balls. After completion of the game, or when the device is ready to be collapsed for transportation and storage, fastener 18 is moved in the reverse directions described previously. In particular, fastener 18 is rotated radially away from second end portion 24*b* and moved longitudinally towards handle 26. Fastener 18 is then rotated radially towards first end portion 24*a*, thereby securing the extensible member 16 in a retracted position. The device is then ready for transportation and storage.

Accordingly, the present invention provides a ball shagger and carrying device which is easy and convenient to use. Additionally, the device in accordance with the present invention includes a retractable shagger which allows for easy transportation and storage of the device and which eliminates dirt build-up.

In an alternative embodiment of the present invention, the shagger is radially adjustable such that the diameter of the tube can be varied to shag and house tennis, baseball and/or golf balls. This multi-sport shagging device is also retractable so that storage and travel are convenient.

It should be appreciated by those skilled in the art that the specific embodiments disclosed above may be readily utilized as a basis for modifying or designing other structures for carrying out the same purposes of the present invention. It should also be realized by those skilled in the art that such equivalent constructions do not depart from the spirit and scope of the invention as set forth in the appended claims.

What is claimed is:

1. A retractable ball shagger and carrying device, comprising:

a tubular body extensible tubular member telescopically connected with the tubular body for movement between extended and retracted positions;

a housing for receiving shagged balls connected to the tubular body;

means for securing the extensible tubular member in the extended and the retracted positions; and a shagging mechanism for shagging balls into the extensible member.

2. The retractable ball shagger and carrying device as described in claim 1, wherein the extensible tubular member has a plurality of apertures formed therein, wherein contaminants are forced out of the apertures when the extensible member moves between the extended position and the retracted position.

3. The retractable ball shagger and carrying device as described in claim 1 wherein the housing includes a bag.

4. The retractable ball shagger and carrying device as described in claim 3 wherein the bag has a resealable opening for removing shagged balls.

5. The retractable ball shagger and carrying device as described in claim 3 further including a handle attached to the bag.

6. The retractable ball shagger and carrying device as described in claim 3 wherein the housing includes a plate positioned at each end of the bag.

7. The retractable ball shagger and carrying device as described in claim 1 wherein the shagging mechanism has a diameter slightly larger than a golf ball.

8. The retractable ball shagger and carrying device as described in claim 1 wherein the shagging mechanism has a diameter slightly larger than a tennis ball.

9. The retractable ball shagger and carrying device as described in claim 1 wherein the shagging mechanism has a diameter slightly larger than a baseball.

10. The retractable ball shagger and carrying device as described in claim 1 further including a slot extending along the longitudinal axis of the tubular body; and a fastener attached to the extensible member and slidably positioned within the slot.

11. The retractable ball shagger and carrying device as described in claim 10 wherein the means for securing includes first and second end portions formed at the ends of the slot and extending perpendicular thereto, such that the fastener is positioned in the second end portion of the slot when the extensible member is extended and such that the fastener is positioned in the first end portion of the slot when the extensible member is in the retracted position.

12. The retractable ball shagger and carrying device as described in claim 1 wherein the shagging mechanism further includes a plurality of recesses extending longitudinally on the shagging mechanism and a plurality of shagging members corresponding to the number of recesses, each shagging member having an elongated portion and a lip portion, the elongated portions positioned within recesses of the shagging mechanism and attached thereto, the lip portions each covering a portion of a first end of the shagging mechanism and extending at an inward angle such that when pressure is imparted on a ball to be shagged, the shagging members extend outward to allow the ball to enter the shagging mechanism and then return to the original positions, thereby trapping the ball in the shagging mechanism.

13. The retractable ball shagger and carrying device as described in claim 1 wherein the shagging mechanism shags both deformable and nondeformable balls.

14. A retractable ball shagger and carrying device, comprising:

a tubular body;

an extensible tubular member telescopically connected with the tubular body for movement between and retracted positions, the extensible member defining a plurality of apertures such that contaminates are forced out of the apertures when the extensible member moves between the extended position and the retracted position; and a shagging mechanism for shagging balls into the extensible member.

15. The retractable ball shagger and carrying device as described in claim 14, further including a retaining member having first and second ends and having an inner and outer diameter, the first end of the retaining member attached to a second end of the tubular body and the second end of the retaining member attached to the extensible member.

16. The retractable ball shagger and carrying device as described in claim 14, further including a housing for shagged balls connected to the first end of the tubular body.

17. The retractable ball shagger and carrying device as described in claim 16 wherein the housing includes a bag having a resealable opening for removing shagged balls, a handle attached to the bag, and a plate positioned at each end of the bag.

18. The retractable ball shagger and carrying device as described in claim 16 wherein the shagging mechanism has a diameter slightly larger than a golf ball.

19. The retractable ball shagger and carrying device as described in claim 14 further including a slot extending along the longitudinal axis of the extensible member; and a fastener attached to the tubular body and slidably positioned within the slot.

20. The retractable ball shagger and carrying device as described in claim 19 further including a means for securing the extensible tubular member in the extended and the retracted positions, comprising first and second end portions formed at the ends of the slot and extending perpendicular thereto, such that the fastener is positioned in the second end portion of the slot when the extensible member is extended and such that the fastener is positioned in the first end portion of the slot when the extensible member is in the retracted position.

21. The retractable ball shagger and carrying device as described in claim 14 wherein the shagging mechanism further includes a plurality of recesses extending longitudinally on the shagging mechanism and a plurality of shagging members corresponding to the number of recesses, each shagging member having an elongated portion and a lip portion, the elongated portions positioned over the recesses of the shagging mechanism and attached thereto, the lip portions each covering a portion of an end of the shagging mechanism and extending at an inward angle such that when pressure is imparted on a ball to be shagged, the shagging members extend outward to allow the ball to enter the shagging mechanism and then return to the original positions, thereby trapping the ball in the shagging mechanism.

* * * * *